US006800042B2

(12) United States Patent
Braithwaite

(10) Patent No.: US 6,800,042 B2
(45) Date of Patent: Oct. 5, 2004

(54) MULTI-PURPOSE GOLF ACCESSORY

(76) Inventor: David M. Braithwaite, 1782 S. 1510 West, Woods Cross, UT (US) 84087

( * ) Notice: Subject to any disclaimer, the term of this patent is extended or adjusted under 35 U.S.C. 154(b) by 0 days.

(21) Appl. No.: 10/427,653

(22) Filed: Apr. 30, 2003

(65) Prior Publication Data

US 2003/0207730 A1 Nov. 6, 2003

Related U.S. Application Data

(60) Provisional application No. 60/377,080, filed on May 1, 2002.

(51) Int. Cl.[7] ..... A63B 57/00
(52) U.S. Cl. ..... 473/408; 473/406
(58) Field of Search ..... 473/406, 408, 473/386, 286; D21/793; 224/918

(56) References Cited

U.S. PATENT DOCUMENTS 4,535,987 A 8/1985 Dikoff
4,960,239 A * 10/1990 Wait ..... 473/406
5,143,371 A 9/1992 Strahan
5,419,551 A 5/1995 Hoyt et al.
5,562,553 A 10/1996 Digerness et al.
5,769,740 A * 6/1998 Colangelo ..... 473/408
5,934,530 A 8/1999 Antczak et al.
6,033,322 A 3/2000 England
6,102,201 A 8/2000 Marston et al.
6,162,137 A 12/2000 Jones et al.
6,202,911 B1 3/2001 Freer
6,220,973 B1 * 4/2001 Hsu ..... 473/408
6,290,617 B1 9/2001 Cole et al.
6,413,173 B1 * 7/2002 Muller et al. ..... 473/408
D471,944 S * 3/2003 Freitas et al. ..... D21/793

* cited by examiner

*Primary Examiner*—Steven Wong
(74) *Attorney, Agent, or Firm*—Clayton, Howarth & Cannon, P.C.

(57) ABSTRACT

A multi-purpose golf accessory includes a divot repair tool pivotally attached to a cover. A ball marker may be removably attached to a top portion of the cover, and a glove attachment device, such as hook and loop fasteners, may be positioned on a lower portion of the cover. A surface may be defined on the cover between the ball marker and the glove attachment device for displaying a visual image. The cover may have a resilient clip for attaching the golf accessory to the apparel of a user.

20 Claims, 5 Drawing Sheets

MULTI-PURPOSE GOLF ACCESSORY

CROSS-REFERENCE TO RELATED APPLICATIONS

This application claims the benefit of U.S. Provisional Application No. 60/377,080, filed May 1, 2002, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND OF THE INVENTION

1. The Field of the Invention

The present invention relates generally to golf accessories, and more particularly, but not necessarily entirely, to a device incorporating various tools that are useful in playing golf, such as divot repair tools, ball markers, and glove holders.

2. Description of Related Art

Various tools and accessories are commonly used to assist in playing golf. For example, when a golf ball lands on the green, it may leave a ball mark or indentation. This indentation, commonly called a divot, may sometimes cause problems for future golfers, such as causing irregular rolling of the golf balls. It is standard golf practice for golfers to repair their own divots as they play the course. Golfers often repair divots with a small hand-held device with two sharp prongs, called a divot tool. The divot tool may be inserted into the ground to pry under the divot and thereby level the golf surface.

Also, ball markers are customarily used to mark a ball position on the golf green so that the ball can be removed to allow other golfers to putt on the green. Ball markers may be small disk shaped objects about the size of a dime. The markers may have a projection in the center of one side to attach the marker to the golf green. Due to the small size of the ball markers, they are often misplaced or difficult to access when desired.

Additionally, golfers often use gloves to improve their grip on the golf clubs and protect their hands. Golfers commonly remove the gloves at different times during the game thereby creating the opportunity to misplace the gloves.

Devices are known in the art for organizing golfing accessories. For example, U.S. Pat. No. 5,934,530 (granted Aug. 10, 1999 to Antczak et al.) discloses a golf accessory organizer. The device is configured for carrying various golfing accessories such as tees, golf balls, gloves, divot tools, ball markers and personal items. The device is worn about the belt so that the accessories can be accessed. However, the size and configuration of the device may be cumbersome and interfere with a person's ability to play golf.

Also, U.S. Pat. No. 5,143,371 (granted Sep. 1, 1992 to Strahan) discloses a golfer's aid that includes a clip that can be attached to the belt. A divot tool and ball marker may be attached to the clip. Also, a strip of hook and loop fabric is attached to the clip for attaching a glove to the clip. However, since the accessories are attached directly to the clip, the clip must have a relatively large dimension. Thus, the clip is the dominant feature of the device and the device is not configured in an aesthetically pleasing manner.

The prior art is thus characterized by several disadvantages that are addressed by the present invention. The present invention minimizes, and in some aspects eliminates, the above-mentioned failures, and other problems, by utilizing the methods and structural features described herein.

In view of the drawbacks inherent in the available art, it would be an advancement in the art to provide a device that allows for the organization of various tools used by golfers in a manner that does not interfere with the golfer's ability to play golf. It would also be an advancement in the art to provide a device that is simple in use and manufacture. It would be a further advancement in the art to provide a device that can be used for promotional purposes, and that has an aesthetically pleasing and compact configuration.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1:
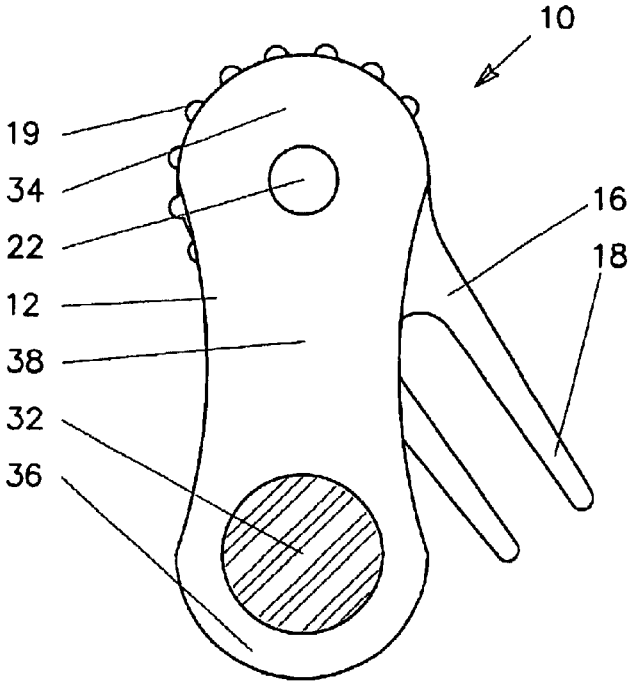
FIG. 1 is a plan view of a multi-purpose golf accessory in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise. Also, as used herein, "comprising," "including," "containing," "characterized by," and grammatical equivalents thereof are inclusive or open-ended terms that do not exclude additional, unrecited elements or method steps. Moreover, as used herein, "consisting of" and grammatical equivalents thereof exclude any element, step, or ingredient not specified in the claim.

Figure 2:
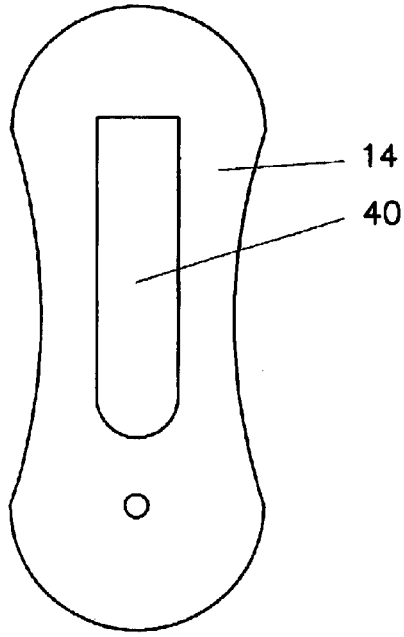
FIG. 2 is a rear plan view of the multi-purpose golf accessory of FIG. 1.

Referring now to FIG. 1 a plan view of a multi-purpose golf accessory device, indicated generally at 10, is shown in accordance with the principles of the present invention. The golf accessory device 10 may include a first cover 12 defining a first side of the device 10, and a second cover 14 defining a second side of the device 10, as shown in FIG. 2.

Figure 3:
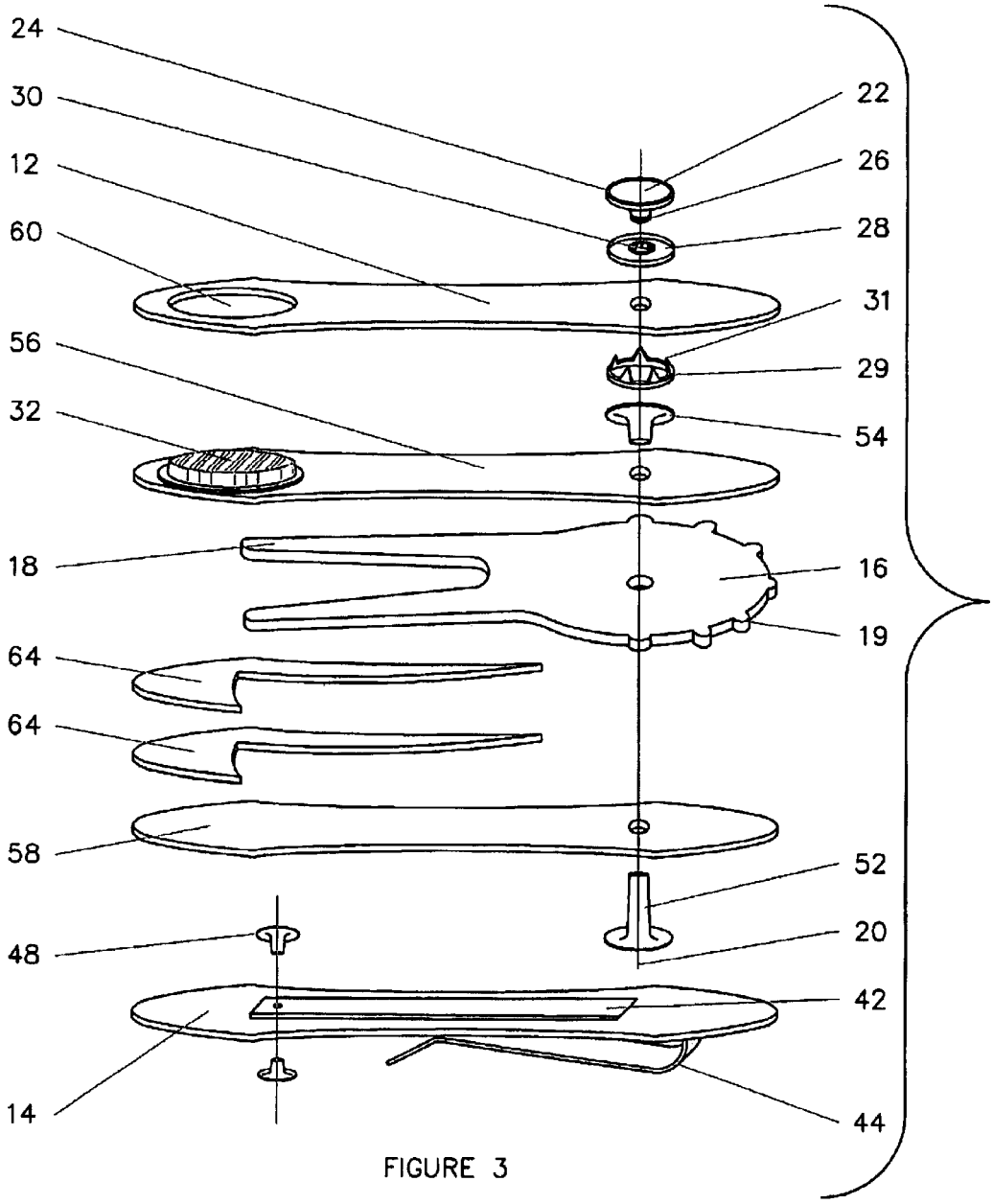
FIG. 3 is an exploded perspective view of the multi-purpose golf accessory of FIG. 1.
Figure 6:
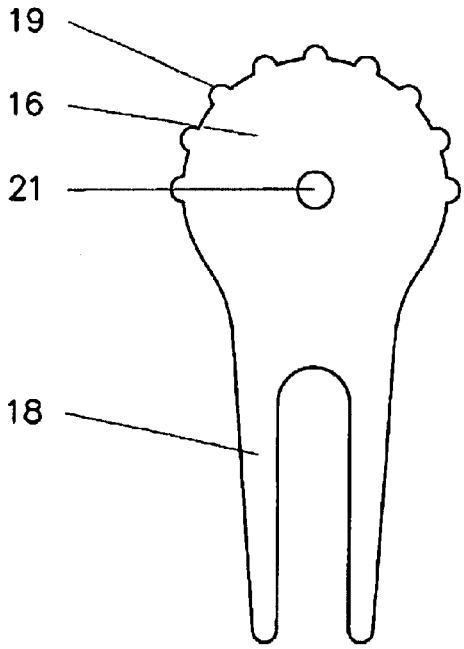
FIG. 6 is a plan view of a divot tool.

The multi-purpose golf accessory device 10 may include a divot repair tool 16 between the first cover 12 and the second cover 14. A plan view of the divot repair tool 16 is shown in FIG. 6. The divot repair tool 16 may have a pair of opposing prongs 18. It will be appreciated by those skilled in the art that the prongs 18 may be configured to be inserted into the ground under a divot in a golf green to pry the divot into a level condition. The divot repair tool 16 may be pivotally attached to the first cover 12 and the second cover 14 at an axis 20 as best shown in FIG. 3. A divot repair tool opening 21 may be formed in the divot repair tool 16 to facilitate attachment of the divot repair tool 16 at the axis 20. The divot repair tool 16 may include one or more knobs 19 on an end opposite the prongs 18. The knobs 19 may extend beyond the first cover 12 and the second cover 14 to enable a user to contact the divot repair tool 16 to rotate the divot repair tool 16 from a retracted position, where the prongs 18 reside between the first cover 12 and the second cover 14, to an extended position where the prongs 18 extend beyond the first cover 12 and the second cover 14 for use in repairing a divot. This allows the multi-purpose golf accessory 10 to have a compact configuration while maintaining an aesthetically pleasing appearance and safe storage of the divot repair tool 16.

A ball marker 22 may be removably attached to the multi-purpose golf accessory device 10 at the axis 20. The ball marker 22 may be formed as a disk member having a bottom surface 24 and a projection 26 extending from the bottom surface 24 as best shown in FIG. 3. The projection 26 may be configured to seat the ball marker 22 into the golf green and also to attach the ball marker 22 to a keeper 28 attached to the first cover 12 of the multi-purpose golf accessory device 10.

The keeper 28 may be attached to the first cover 12 by a clasp 29 having pointed tabs 31. The pointed tabs 31 may penetrate the first cover 12 and may be bent around the keeper 28 to hold the keeper 28 in position. It will be appreciated that the keeper 28 may be attached to the first cover 12 using other attachment mechanisms within the scope of the present invention. The keeper 28 may have an opening 30 sized to receive the projection 26 such that the ball marker 22 may be snapped onto the keeper 28. Thus, the ball marker 22 may be stored on the keeper 28 and removed when desired for use in playing golf.

The position of the ball marker 22 on the axis 20 provides an advantage of allowing the projection 26 to be inserted into the keeper 28 along the axis 20 without inhibiting the rotation of the divot repair tool 16. Moreover, the location of the ball marker 22 on the axis 20 provides an aesthetically pleasing and compact configuration.

The multi-purpose golf accessory device 10 may also include a means 32 for attaching a glove (not shown) to the device. The means 32 for attaching a glove may include hook and loop fasteners, for example, attached to the first cover 12. Golf gloves commonly include a wrist band having hook and loop fasteners for adjustably fastening the glove to the user. The hook and loop fasteners of the glove may be attached to the hook and loop fasteners on the multi-purpose golf accessory device 10 to removably attach the glove to the multi-purpose golf accessory device 10. This provides a place to store the gloves and provides easy access to the gloves so that the gloves are less likely to be misplaced.

The ball marker 22 may be positioned on a first end portion 34 of the first cover 12, and the means 32 for attaching a glove may be located on a second end portion 36 of the first cover 12. The first cover 12 may also have a surface 38 positioned between the first end portion 34 and the second end portion 36 for displaying a visual image such as a logo or advertisement, or any other character, symbol, or depiction. This provides the advantage that the multi-purpose golf accessory device 10 may be used as a promotional item to promote goods or services, for example, related to the visual image.

The second side 14 of the multi-purpose golf accessory device 10 may include a clip 40 for attaching the device 10 to an article of apparel, such as a belt or pocket, of the user. As shown most clearly in FIGS. 3 and 5, the clip 40 may include a planar portion 42 and a loop 44. The clip 40 may be made of a resilient material to provide spring-like characteristics so that the loop 44 may be expanded to receive an article of apparel, and then contract to compressively hold the article of apparel between the loop 44 and the planar portion 42. Those skilled in the art will appreciate that the clip 40 may be made of thin stainless steel or plastic for example, or any other such material to provide resiliency and elasticity to the clip 40.

Figure 4A:
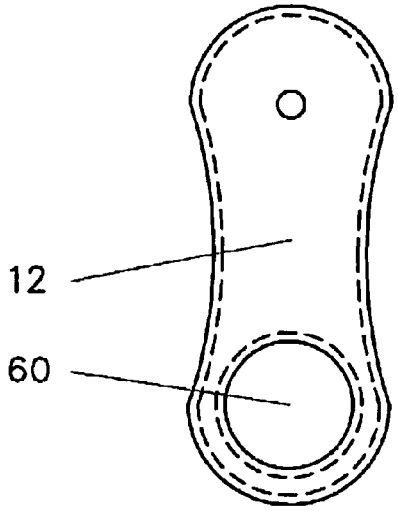
FIG. 4*a* is a plan view of a first cover on the exterior of the multi-purpose golf accessory.
Figure 4B:
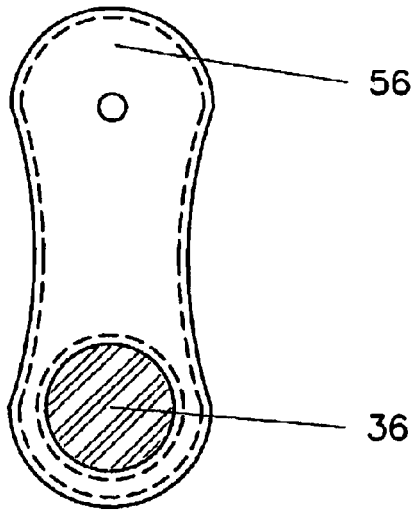
FIG. 4*b* is a plan view of a first cover inner layer.
Figure 4C:
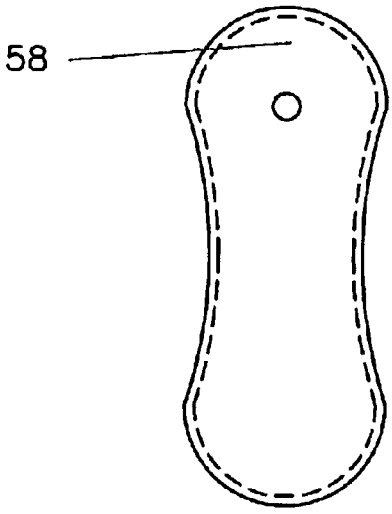
FIG. 4*c* is a plan view of a second cover inner layer.
Figure 4D:
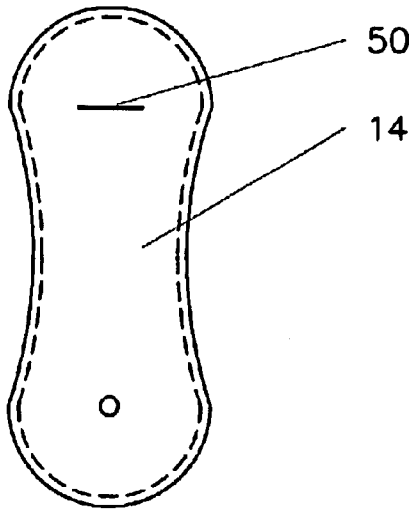
FIG. 4*d* is a plan view of a second cover of the multi-purpose golf accessory.

The clip 40 may also include an aperture 46 for receiving a clip rivet 48 for attaching the clip 40 to the second cover 14. The second cover 14 may also include a slot 50, as best shown in FIG. 4*d,* for receiving the clip 40 such that the planar portion 42 and the loop 44 may be disposed on opposite sides of the second cover 14. Thus, a large portion of the clip 40 may be hidden from view to provide the multi-purpose golf accessory device 10 in an aesthetically pleasing configuration.

Figure 5A:
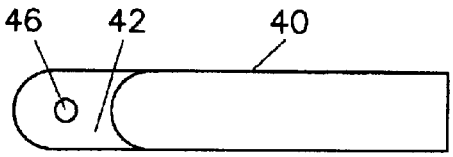
FIG. 5*a* is a plan view of a clip.
Figure 5B:
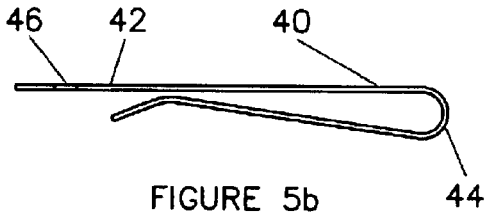
FIG. 5*b* is a side view of a clip.
Figure 5C:
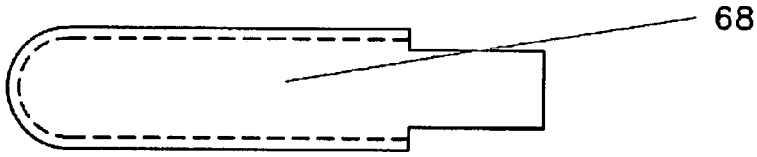
FIG. 5*c* is a plan view of a first side of a clip cover.
Figure 5D:
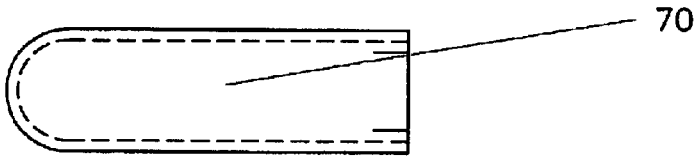
FIG. 5*d* is a plan view of a second side of a clip cover.
Figure 5E:
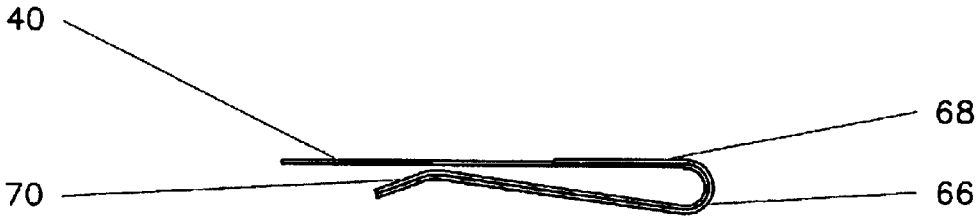
FIG. 5*e* is a side view of a clip and clip cover.

As shown most clearly in FIGS. 5*c*–5*e,* one embodiment of the golf accessory device 10 may include a clip cover 66 for covering the clip 40. The clip cover 66 may have a first side 68 and a second side 70. The first side 68 may be fastened to the second side 70 by stitching or by use of adhesives, for example, such that the clip 40 may received between the first side 68 and the second side 70 so as to be covered and protected. Thus, the clip cover 66 may prevent any sharp edges that may be created by the clip 40 from being exposed, and the clip cover 66 may add an aesthetically pleasing look to the clip 40.

Figure 7:
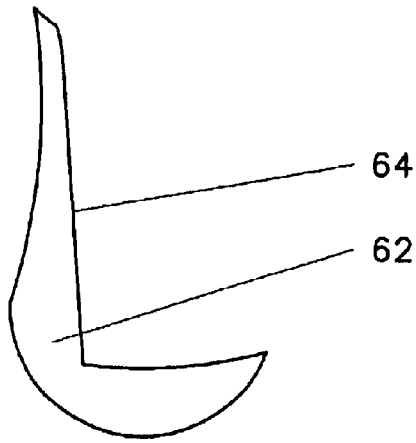
FIG. 7 is a plan view of an insertion piece.

As shown in FIGS. 3 and 7, the golf accessory device 10 may include one or more insertion pieces 62. The one or more insertion pieces 62 may be positioned between the first cover 12 and the second cover 14 at the second end portion 36 of the golf accessory device 10. The one or more insertion pieces 62 may be configured to maintain a space between the first cover 12 and the second cover 14 for receiving the divot repair tool 16. It will be understood that any number of insertion pieces 62 may be used within the scope of the present invention to provide a desired spacing for receiving the divot repair tool 16 between the first cover 12 and the second cover 14. Moreover, certain embodiments of the present invention may be formed without any insertion pieces 62.

The insertion pieces 62 may also form a stop portion 64 to prevent the divot repair tool 16 from rotating beyond the stop portion 64. One embodiment of the insertion pieces 62 may be made of leather, and may be attached to the first cover 12, the second cover 14, and other insertion pieces 62 by stitching or an adhesive for example. However, it will be appreciated that the insertion pieces 62 may be made of other materials, and other attaching mechanisms may be used to attach the insertion pieces 62 to the first cover 12 and the second cover 14 within the scope of the present invention.

The components of the multi-purpose golf accessory device 10 may be connected together using a rivet 52 and rivet retainer 54 for example. However, those skilled in the art will appreciate that other attachment mechanisms may be used within the scope of the present invention. The rivet 52 and rivet retainer 54 may be hidden from view by a first cover inner layer 56 and a second cover inner layer 58, as best shown in FIGS. 3 and 4. The first cover inner layer 56 may be attached to the first cover 12 by any manner known in the art such as sewing or adhesives for example. The second cover inner layer 58 may also be connected to the second cover 14 by any manner known in the art.

In one embodiment of the present invention, the means 32 for attaching a glove may be attached to the first cover inner layer 56, and extend through an opening 60 in the first cover 12. However, as those skilled in the art will appreciate, the means 32 for attaching a glove may be positioned directly on the first cover 12 within the scope of the present invention.

The first cover 12, the second cover 14, the first cover inner layer 56 and the second cover inner layer 58 may be formed of a leather material for example. However it will be appreciated that other materials that provide a durable and aesthetically pleasing support may be used to construct the covers of the device 10 within the principles of the present invention.

It will be understood that some embodiments of the present invention may not include all of the forgoing features. For example, one embodiment of the present invention may not include the ball marker 22. Another embodiment may not include the clip cover 66, or the insertion piece 62. Thus, any combination of the above described features are contemplated within the scope of the present invention.

It will be appreciated that the structure and apparatus disclosed herein is merely one example of a means for attaching a glove, and it should be appreciated that any structure, apparatus or system for attaching a glove which performs functions the same as, or equivalent to, those disclosed herein are intended to fall within the scope of a means for attaching a glove, including those structures, apparatus or systems for attaching a glove which are presently known, or which may become available in the future. Anything which functions the same as, or equivalently to, a means for attaching a glove falls within the scope of this element.

Those having ordinary skill in the relevant art will appreciate the advantages provided by the features of the present invention. For example, the present invention provides a device that allows for the organization of various tools used by golfers and the device does not interfere with the golfer's ability to play golf. The present invention also provides a device that is simple in use and manufacture. The present invention further provides a device that can be used for promotional purposes, and which has an aesthetically pleasing and compact configuration.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A golf accessory device comprising:

a first cover defining a first side of said device;

a second cover defining a second side of said device;

a divot tool positioned between said first cover and said second cover for repairing divots in a golfing surface;

a ball marker removably attached to said first cover;

a clip attached to said second cover for attaching said device to an article of apparel;

means for attaching a glove to said device, said means for attaching being disposed on said first cover; and a first cover inner layer attached to said first cover, and a second cover inner layer attached to said second cover.

2. The golf accessory device of claim 1, wherein said divot tool comprises opposing prongs on one end and knobs on an opposing end, said knobs extending beyond said first cover and said second cover for providing a gripping surface for rotating said divot tool.

3. The golf accessory device of claim 1, wherein said divot tool is pivotally attached to said first cover and said second cover at a pivot axis.

4. The golf accessory device of claim 3, wherein said ball marker is attached to said device at a point along said pivot axis.

5. The golf accessory device of claim 1, wherein said means for attaching a glove to said device comprises hook and loop fasteners.

6. The golf accessory device of claim 1, wherein said ball marker comprises a disk member having a top side and a bottom side, and wherein a projection extends from a central portion of said bottom side.

7. The golf accessory device of claim 1, wherein said clip comprises a loop formed of a resilient material.

8. The golf accessory device of claim 1, wherein said second cover comprises a slot for receiving said clip.

9. The golf accessory device of claim 1, wherein said ball marker is attached to a first end of said device and said means for attaching a glove is disposed on a second end of said device, and a surface is disposed between said ball marker and said means for attaching a glove, said surface being configured for displaying a visual image.

10. A golf accessory device comprising:

a divot tool comprising a pair of spaced apart prongs for repairing divots in a golfing surface, said divot tool pivotally disposed on a pivot axis;

an opening defined on said pivot axis;

a ball marker attachable to said pivot axis, said ball marker comprising a disk member having a bottom surface and a projection extending from said bottom surface;

wherein said protection is received in said opening when said ball marker is attached to said pivot axis.

11. The golf accessory device of claim 10, wherein said projection extends along said pivot axis.

12. The golf accessory device of claim 10, further comprising means for attaching a glove to said device.

13. The golf accessory device of claim 12, wherein said means for attaching a glove to said device comprises hook and loop fasteners.

14. The golf accessory device of claim 10, further comprising a clip for attaching said device to an article of apparel.

15. The golf accessory device of claim 10, further comprising a first cover and a second cover, wherein said divot tool is disposed between said first cover and said second cover.

16. A golf accessory device comprising:

a first cover defining a first side of said device;

a second cover defining a second side of said device;

a divot tool rotatably connected between said first cover and said second cover for repairing divots in a golfing surface, wherein said divot tool comprises opposing prongs on one end and knobs on an opposing end, said knobs extending beyond said first cover and said second cover for providing a gripping surface for rotating said divot tool;

means for attaching a glove to said device, said means for attaching a glove being disposed on said first cover; and a clip attached to said second cover for attaching said device to an article of apparel.

17. The golf accessory device of claim 16, wherein said means for attaching a glove to said device comprises hook and loop fasteners.

18. The golf accessory device of claim 16, further comprising a first cover inner layer attached to said first cover, and a second cover inner layer attached to said second cover.

19. The golf accessory device of claim 16, wherein said divot tool is pivotally attached to said first cover and said second cover at a pivot axis;

a ball marker removably attached to said first cover;

wherein said ball marker is attached to said device at a point along said pivot axis;

wherein said ball marker comprises a disk member having a top side and a bottom side, and wherein a projection extends from a central portion of said bottom side;

wherein said ball marker is attachable to said pivot axis such that said projection extends along said pivot axis;

wherein said means for attaching a glove to said device comprises hook and loop fasteners;

wherein said device further comprises a first cover inner layer attached to said first cover, and a second cover inner layer attached to said second cover;

wherein said first cover inner layer and said second cover inner layer are connected together through a rivet;

wherein said clip comprises a loop formed of a resilient material;

wherein said second cover comprises a slot for receiving said clip;

wherein said ball marker is attached to a first end portion of said device and said means for attaching a glove is disposed on a second end portion of said device, and a surface is disposed between said ball marker and said means for attaching a glove, said surface being configured for displaying a visual image;

wherein said device further comprises one or more insertion pieces between said first cover and said second cover;

wherein said one or more insertion pieces comprise a stop for preventing rotation of said divot tool beyond said stop;

wherein said device further comprises a clip cover for covering said clip.

20. The golf accessory device of claim 10, wherein a keeper is disposed on said pivot axis and said opening is defined by said keeper.

* * * * *